United States Patent [19]

Huhne et al.

[11] 3,986,668

[45] Oct. 19, 1976

[54] SAFETY DOUBLE INJECTOR SPRAY DEVICE OR TORCH

[75] Inventors: Erwin Huhne, Schallstadt, Germany; Hans-Theo Steine, Crissier; Wolfgang Simm, Lausanne, both of Switzerland

[73] Assignee: Eutectic Corporation, Flushing, N.Y.

[22] Filed: Dec. 23, 1975

[21] Appl. No.: 643,823

[30] Foreign Application Priority Data

Jan. 9, 1975 Austria ..... 6A 130/75

[52] U.S. Cl. ..... 239/85; 239/413; 239/419; 239/424; 239/427.5; 239/132.3

[51] Int. Cl.[2] ..... B05B 1/24; B05B 7/02; B05B 15/00

[58] Field of Search ..... 239/79, 80, 85, 413, 239/416.1, 419, 422, 419.3, 424, 427, 427.3, 427.5, 132, 132.3

[56] References Cited

UNITED STATES PATENTS

| | | | |
|---|---|---|---|
| 2,072,845 | 3/1937 | Benoit | 239/85 |
| 2,108,998 | 2/1938 | Schort | 239/85 |
| 2,786,779 | 3/1957 | Long et al. | 239/85 X |
| 2,804,337 | 8/1957 | Marantz | 239/79 |
| 3,190,560 | 6/1965 | Schilling et al. | 239/85 |
| 3,226,028 | 12/1965 | Schilling | 239/85 X |
| 3,404,838 | 10/1968 | Hawk | 239/79 |
| 3,415,449 | 12/1968 | Hawk | 239/85 |
| 3,476,320 | 11/1969 | Fleischhacker et al. | 239/85 |

FOREIGN PATENTS OR APPLICATIONS

| | | | |
|---|---|---|---|
| 46,010 | 12/1935 | France | 239/79 |
| 416,452 | 9/1934 | United Kingdom | 239/79 |
| 425,817 | 3/1935 | United Kingdom | 239/79 |
| 707,290 | 4/1954 | United Kingdom | 239/85 |
| 1,140,511 | 1/1969 | United Kingdom | 239/85 |

*Primary Examiner*—Robert S. Ward, Jr.
*Attorney, Agent, or Firm*—Hopgood, Calimafde, Kalil, Blaustein and Lieberman

[57] ABSTRACT

A safety double injector spray device or torch is provided for applying a spray coating to a substrate comprising, a torch body having a torch head at the end thereof, an oxygen duct and a fuel gas duct associated with said spray device and coupled to a first injector means for mixing oxygen and fuel gas therein, a fuel gas-oxygen mixing duct located forward of and coupled to said first injector means, a carrier gas duct associated with said spray device coupled to a second injector means for mixing spray powder with carrier gas fed to said duct, a carrier gas-spray powder mixing duct located forward of said second injector means, spray powder feeding means coupled to said torch body and communicating in powder feeding relationship with said carrier gas duct, and means forward of said first and said second injector means coupling said carrier gas-spray powder mixing duct and said fuel-gas oxygen mixing duct to said torch head.

21 Claims, 12 Drawing Figures

SAFETY DOUBLE INJECTOR SPRAY DEVICE OR TORCH

This invention relates to a safety double injector spray device or torch in which a separate injector is employed for forming a carrier gas-powder mixture from gravity fed powder and a carrier gas and another injector employed for forming a fuel gas-oxygen mixture which subsequently is combined with the carrier gas-powder mixture for carrying out a flame spraying operation.

STATE OF THE ART

Generally speaking, spray devices or guns equipped with powder feeding device function according to the balanced pressure principle. The differential pressure principle is sparingly used in that the corresponding technical problems associated therewith are more complex and difficult to overcome.

Spray guns using the constant or balance pressure principle have certain disadvantages from the point of view of safety due to a tendency for such guns to backflash. There is the danger that explosive gas mixtures penetrating essential parts of a spray gun will explode due to backflashing. The same problem obtains with respect to spray guns operating on the differential pressure principle as will be apparent below.

The principal function of the differential pressure spray gun is fairly simple. The separate components making up the final mixture come or are brought together at certain places of the torch body in the spray gun before being finally deposited in the torch head; however, such spray guns or devices present rather complex problems. These include, besides the danger of backflashing of the flame and/or the fuel gas into the powder container, the additional problems of satisfactory powder feed, proper powder dosage or quantity and powder mixing, the adjustment of the various mechanical components of the gun, wear within the ducts carrying the powder for deposit in the torch head, and the ability to handle the spray gun in different working positions relative to the substrate to be spray coated while still assuring gravity assisted feed of the powder from its container into the powder feed channels or ducts during powder spraying.

The foregoing is important in the flame deposition of metal powder onto one or more base metal parts or substrates in which the application of smooth uniform metal coatings is essential.

As illustrative of the state of the art, reference is made to U.S. Pat. Nos. 2,173,484; 2,726,118; 2,786,779; 2,961,335; and German Pat. Nos. 1,144,563 (Auslegeschrift) and 1,265,630.

OBJECTS OF THE INVENTION

It is thus an object of the invention to overcome the disadvantages inherent in the differential pressure type spray device.

Another object is to provide a differential pressure type spray device in which the design, construction and combination of essential parts are such as to greatly inhibit backflash of explosive gas mixtures, while being capable of ease of adjustment and handling under working conditions.

These and other objects will be clearly apparent when taken in conjunction with the following disclosure and the accompanying drawings, wherein.

STATEMENT OF THE INVENTION

Generally stated, the invention is directed to a safety double injector spray device for applying a spray coating to a substrate, such as a hard face coating, corrosion resistant coating, a build-up coating and the like, the spray device comprising a torch body having a torch head with a nozzle at the end thereof. The spray device has an oxygen duct and a fuel gas duct associated therewith and coupled to a first injector means for mixing said oxygen with said fuel gas, the gases entering a fuel gas-oxygen mixing duct located forward of and coupled to said first injector means.

A carrier gas duct is also provided associated with said gun which is coupled to a second injector means for mixing spray powder with carrier gas fed to and through said duct, the powder and carrier gas entering a carrier gas-powder mixing duct located forward of said second injector means, powder feeding means being couupled to said torch body and communicating in powder-feeding relationship with said carrier gas duct so as to feed powder thereto and into said second injector means.

Lastly, the spray device provides means forward of said first and second injector means coupling said carrier gas-powder mixing duct and said fuel gas-oxygen mixing duct to said torch body for feeding to said torch head.

As regards the latter, the coupling means to the torch body (note FIG. 4) may include means for merging the carrier gas-powder stream and the fuel gas-oxygen stream together before they enter the torch head at the end of the torch body. The area at which the two streams merge is preferably provided with an injector to assure uniform mixing of the two streams before they enter the torch head.

The foregoing system is referred to herein as inside mixing; that is to say, the mixing of the two streams (the carrier gas-powder stream and the fuel gas-oxygen stream) is effected before the streams enter the torch head for combustion at the nozzle.

Figure 2:
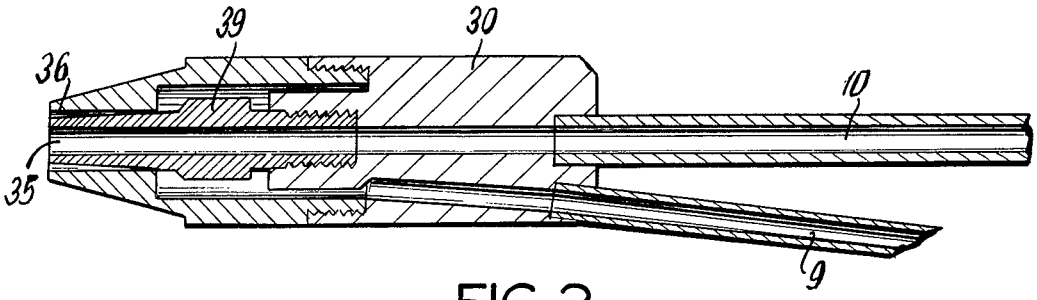
FIG. 2 is a cross section of a torch head in which outside mixing of the powder and gases occur.

On the other hand, the coupling means between the exit streams and the torch head may comprise separate ducts that conduct each of the streams separately to the torch head, the mixing taking place after the gases have left the nozzle (note FIG. 2). This system is referred to as outside mixing.

The foregoing spray device of the invention is not only improved against the danger of backflashing but also offers a device of simple construction for easy handling. The carrier gas may be the oxygen fed to the first injector for use with the fuel gas by employing a branch duct coupling the oxygen duct to the carrier gas duct, or the carrier gas may be another gas from an entirely different source, such as argon or nitrogen. The branch duct leading from the oxygen duct may have an adjustable valve for controlling the flow of oxygen to the carrier gas duct.

The term "carrier gas" is meant to define the gas used to carry the powder to the second injector.

In a particular embodiment, means may be provided for assuring a continuous idle flow or a leak rate flow of carrier gas to said carrier gas duct from the branch duct coupled to the oxygen duct or from a separate line feeding argon or nitrogen as the carrier gas. One means may comprise an adjustable valve which in the closed position provides an idle flow or leak rate flow of gas to the carrier gas duct.

Another means for effecting continuous leak rate flow of carrier gas is to provide a shunt duct coupled to the oxygen duct for shunting a leak rate portion of gas directly to the carrier gas duct.

The idle or leak rate flow of carrier gas aids in further inhibiting backflash when the powder feed is being adjusted during the initial stages of adjusting the flame for flame spraying of the powder.

The valve metering means for controlling the flow of powder to the second injector may comprise a longitudinally movable pin located coaxially within the carrier gas duct at the powder feed portion of the torch body. The details of such a valve will be described later relative to the drawings.

DETAILS OF THE INVENTION

The various embodiments of the invention will clearly appear from the drawings. The spray gun is illustrated in three sections, a middle torch section (FIG. 1) containing preferably the two injectors connected to a forward portion or section shown in either FIGS. 2 or 4 and a back section shown according to FIG. 3 by means of which the gases are fed to the middle torch portion. The external shape of the spray gun is illustrated by way of example in FIGS. 1 to 4, a more compact model being shown in FIG. 5.

Figure 3:
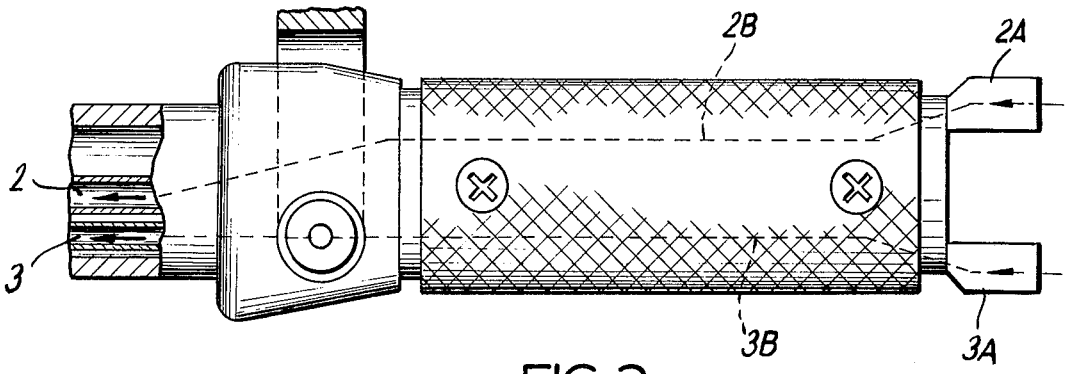
FIG. 3 shows partly in cross section a front view of the torch end of a spray device which serves as a handle as well as for use with either inside or outside mixing.

Thus, referring to FIG. 3, oxygen and fuel gas (e.g. acetylene) are fed to the spray gun via connections 2A, 3A, respectively, the gas passing through ducts shown schematically as 2B, 3B in the handle and emerging as ducts 2 and 3 shown forward of the handle.

Figure 1:
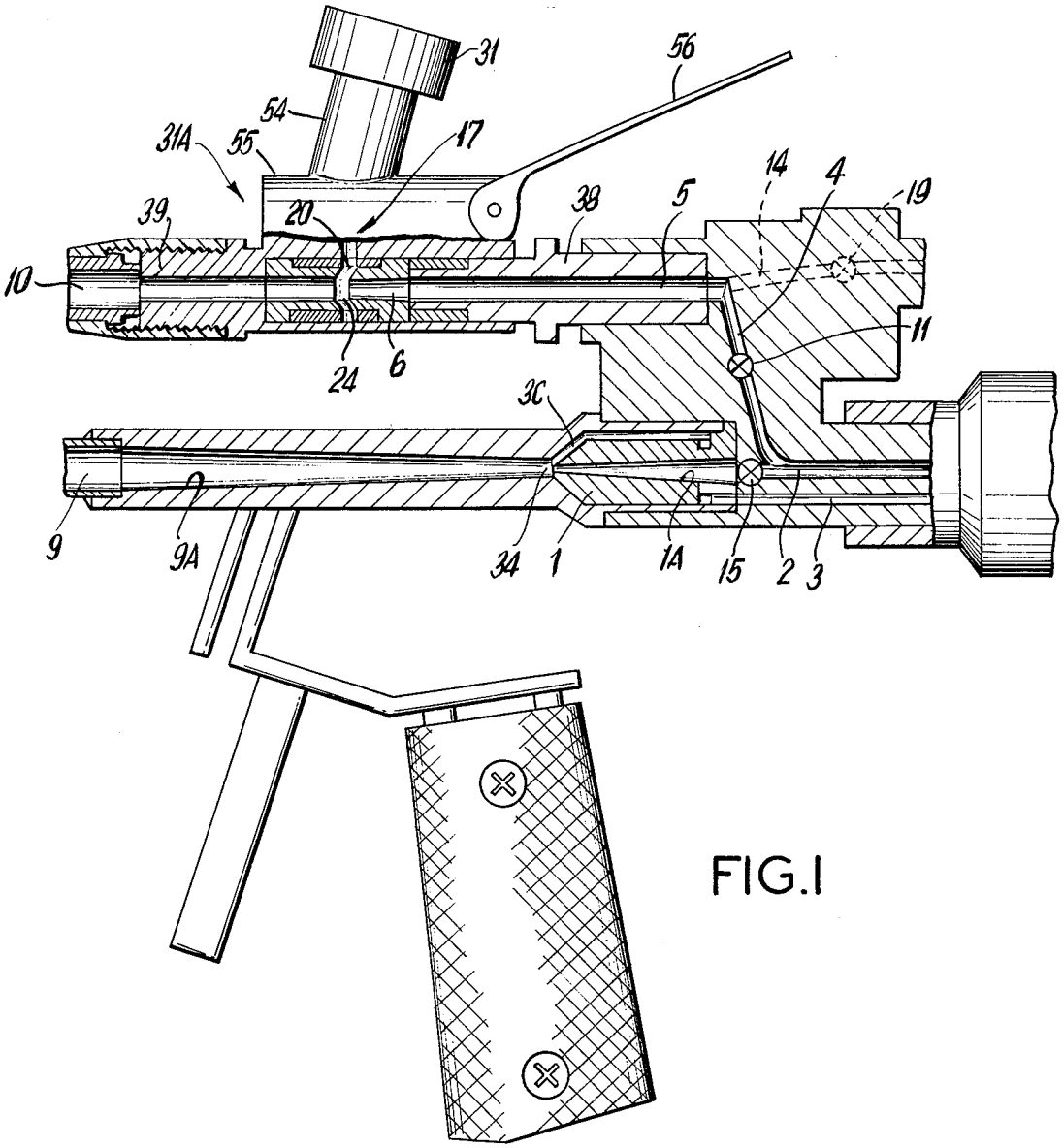
FIG. 1 is a cross section of the middle portion of a spray device showing two injector means, said middle portion being adapted for use in effecting inside or outside mixing of the powder with fuel gas and oxygen.

Referring now to FIG. 1, illustrating the middle section or portion of a spray gun, ducts 2 (oxygen) and 3 (fuel gas) are shown entering the first injector (fuel gas-oxygen injector) 1 with the oxygen duct coaxially entering the central opening or throat 1A of the injector via valve 15, the fuel gas duct 3 being coupled to an annular chamber 3C surrounding the injector such that the flow of oxygen through the throat sucks in the fuel gas and effectively causes the two gases to mix at the region 34 just forward of the tapered nose of injector 1. The annular chamber 3C is positioned according to spacers or small ribs on the injector body. The fuel gas-oxygen mixture enters fuel gas-oxygen duct 9 via connecting channel 9A as shown.

Figure 4:
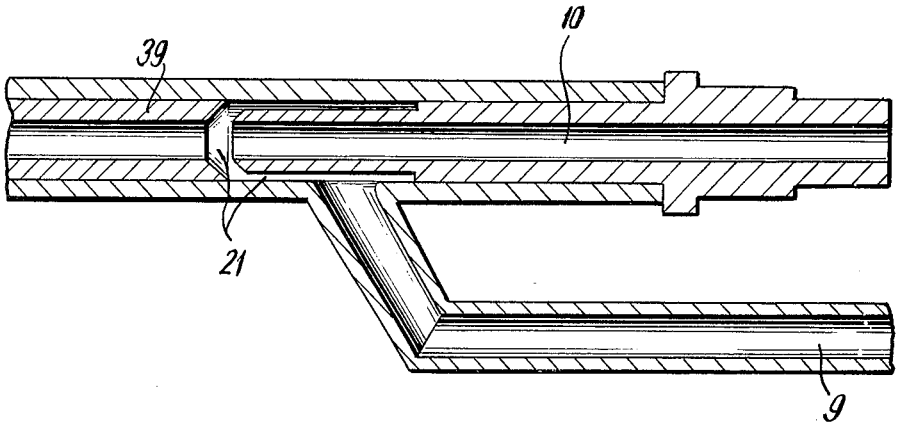
FIG. 4 is a schematic cross section of one embodiment for producing inside mixing of the powder and the gases.

The fuel gas-oxygen mixture flows through duct 9 as shown in either FIG. 2 or FIG. 4, depending on whether the gases and the spray powder are to be subjected to inside mixing or outside mixing. In any event, the fuel gas-oxygen mixture reaches torch head 30 (FIGS. 2 or 5) and emerges therefrom as a flame via orifice outlets 36 shown in either FIG. 2 or FIG. 9, the orifices being concentrically arranged around the carrier gas-powder bore 35 coaxially coupled to carrier gas-powder duct 10 (e.g. oxygen carrier gas) shown in FIG. 2. The channel or duct in torch head 30 is preferably provided with a liner 39 of wear resistant material, e.g. sintered tungsten carbide (note FIGS. 1, 4 and 5).

The coupling of ducts 9 and 10 directly to torch head 30 in FIG. 2 results in outside mixing of the powder and gases; whereas, the merging of ducts 9 and 10 into an injector region 21 shown in FIG. 4 prior to going to the torch head results in inside mixing of the powder and flow gases.

Figure 5:
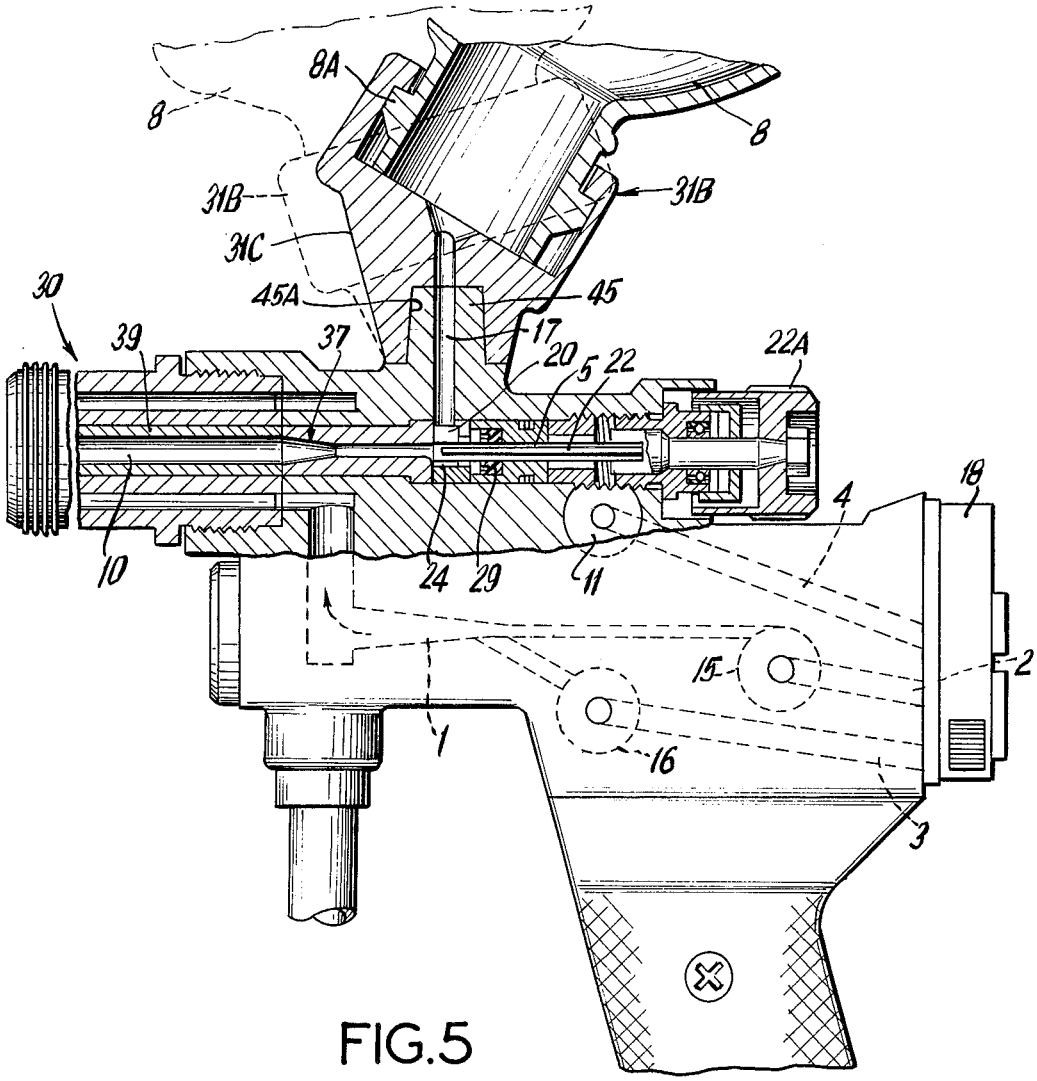
FIG. 5 is a compact model of one embodiment of a spray gun in which outside mixing of the powder and gases is employed, that is, mixing in the torch head of the gun adjacent the nozzle.
Figure 9:
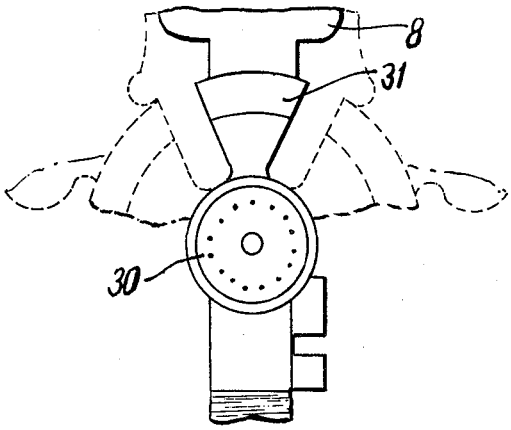
FIG. 9 depicts schematically in elevation looking at the torch nozzle various positions of the powder container on the spray device.
Figure 10:
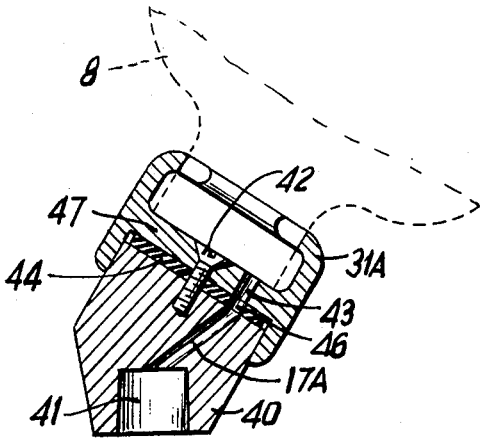
FIG. 10 is a detail of a coupling device or connection for coupling the powder container to the spray device.

Referring again to FIG. 1, the powder flow to the torch head is achieved with a carrier gas (e.g. oxygen, argon or nitrogen) which carries the powder towards the torch head. The feeding of the powder is preferably gravity assisted from a container connected to coupling or connecting piece 31 shown in FIG. 1, the container 8 being positioned as shown in FIGS. 5, 9, and 10. In FIG. 1, the carrier gas may optionally comprise a duct 14 (for outside gas) entering the torch body as shown having a shut-off valve 19 located in said duct, the duct 14 being coupled to carrier gas duct 5 as shown.

However, in a preferred embodiment, the carrier gas is supplied from oxygen duct 2 via a branch line 4 coupled from back of valve 15 to carrier gas duct 5, a shut-off valve 11 being provided in duct line 4. Thus, oxygen employed as the carrier gas flows through carrier gas duct 5 in channel connecting piece 38 in direct line to powder feed station 31A to be described in more detail later. However, the carrier gas picks up the powder fed by gravity through powder feed channel 17 for transport to carrier gas-powder duct 10.

In a preferred embodiment, the spray gun utilizes a carrier gas idling safety device, that is to say, a controlled leak rate of gas from duct 2 through duct valve 11 into carrier gas duct 5. The idle or leak rate flow of carrier gas can be achieved in several ways.

Figure 7:
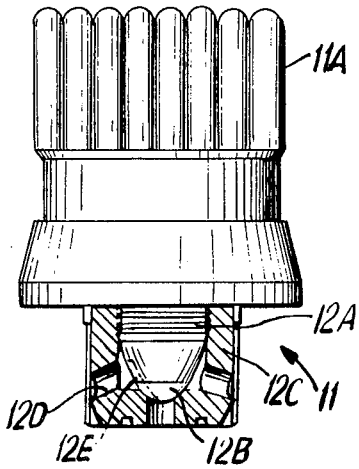
FIG. 7 shows partly in cross section in front elevation a valve for regulating carrier gas current in a spray device, said valve comprising a valve stem and a valve head adapted to adjust or close off the flow of carrier gas.

For example, adjustable valve 11 (shown in greater detail in FIG. 7) may be provided with means to assure a leak rate when the valve is closed. The valve comprises setting means or knob 11A coupled to a valve stem 12A having a valve head 12B which moves up or down in sleeve 12C disposed in the branch line provided with gas inlet and outlet ports 12D. The valve is shown with fine bores or grooves 12E which enable continual flow of carrier gas at a predetermined leak rate when the valve is in a closed position. The continuous leak rate or idle flow aids in inhibiting backflash.

Figure 8:
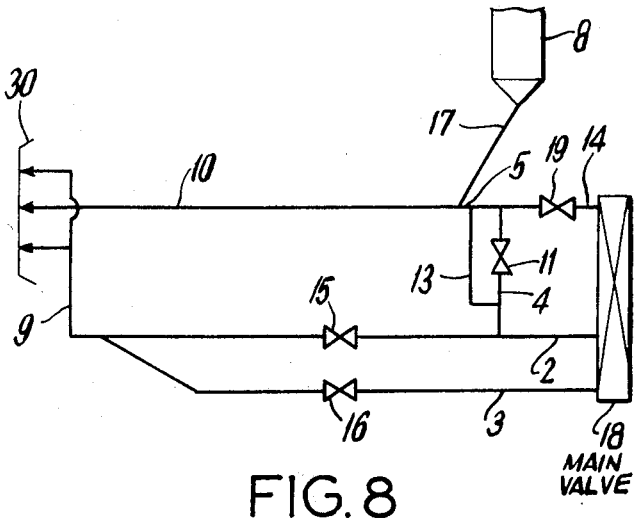
FIG. 8 is a schematic drawing illustrating one embodiment of a circuit system employed to effect powder and gas flow within a spray device.

Another method for providing idle flow is shown in the schematic of FIG. 8 which is a line drawing showing the flow of the constituents which combine to provide a spray product at the torch head nozzle. Thus, gases are brought in via a main control valve 18 in the open position. This valve is generally open and may be used for shutting off all gas flow to the spray gun in one operation.

Thus, FIG. 8 shows optionally a carrier gas feed line 14 (for such gases as argon, nitrogen and other gases) to provide make-up carrier gas by flow through valve 19, if open, to carrier gas duct 5 located back of powder feed channel 17 from container 8 for providing gravity assisted feed of powder from said container to carrier gas-powder duct 10. Instead of using carrier gas from outside line 14, the valve 19 may be closed and carrier gas obtained from oxygen gas duct 2 via branch line 4 having valve 11 therein which may have the built-in leak rate or idle flow means referred to hereinabove. However, the desired leak rate may be provided alternatively by shunt line 13 of predetermined opening which bypasses valve 11 to assure a continual desired leak rate to carrier gas duct 5 prior to mixing with powder fed by gravity by powder feed channel 17 into carrier gas-powder mixing duct 10. Ducts 2 and 3 have adjustable valves 15 and 16, respectively, therein for controlling the fuel gas-oxygen ratio fed to torch head 30 through duct 9 together with the carrier gas-powder mix feed through duct 10.

Returning to FIG. 1, the carrier gas in duct 5 flows into a second injector 6 which communicates with powder feed channel 17 and a carrier gas-powder mixture obtained which flows into duct 10. The handling of the spray gun is improved if the feeding of the powder to injector 6 is adjustable in the quantity fed without requiring manipulation of valve 11 or valve 19. Thus, it would be desirable to have a valve metering device cooperatively associated therewith for adjusting the amount of spray powder fed to the second injector from powder feed channel 17.

Figure 6:
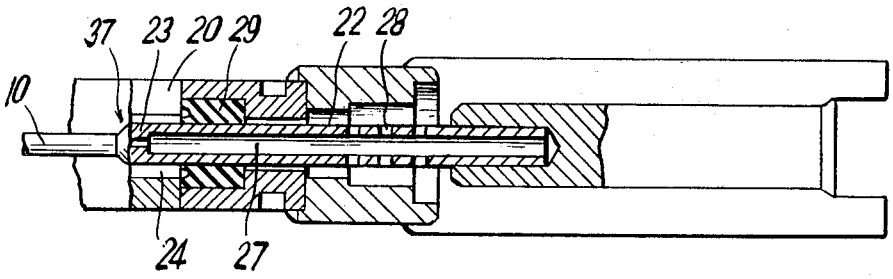
FIG. 6 is a detail drawing of that part of FIG. 5 in cross section showing a valve powder metering means for controlling the flow of powder to the nozzle.

Such a valve metering device is shown in FIGS. 5 and 6. Referring to FIG. 5, a compact spray gun utilizing the novel combination of elements of the invention comprises, by way of example, a torch body having a handle as shown and a mounting spindle for positioning the gun on a fixture relative to a workpiece to be sprayed, the torch body having a powder container 8 connected to it by means of a coupling 31B rotatably supported on a stationary stub shaft 45 of slightly conical shape, the torch body having a torch head 30 at one end terminating into a nozzle.

As will be noted, coupling 31B fits about an annular collar 8A of container 8, the coupling having an extending axially offset portion 31C with a cuplike cavity 45A of slight conical configuration which mates rotatably with stub shaft 45 extending upwardly from the torch body. The offset portion 31C has a powder feed opening therein which aligns with powder feed channel 17 which communicates with said second powder-gas mixing injector located in the torch body shown more clearly by the numeral 6 in FIG. 1.

The valve metering means for controlling the quantity of powder fed to the injector comprises an elongated pin 22 supported coaxially relative to the injector in carrier gas duct 5, the valve setting being achieved via valve adjusting means 22A which causes the pin to move in and out longitudinally by manipulating means 22A. The forward end of the pin is located below powder feed channel 17 and back of the entrance to injector 6. The pin is shown extending to injector area 24 in FIG. 5. In the detail section of FIG. 6, the valve pin 22 is shown with its end 23 substantially against injector gap 37 in the injector area.

It may be advantageous to provide valve pin 22 with a through-hole bore 27 (FIG. 6) and at least one cross channel orifice 28 for conducting carrier gas therethrough, the pin 22 passing in sliding contact through a gasket or bushing 29 at its forward end adjacent injector area 24. The gasket functions to prevent carrier gas from flowing annularly into the injector area and also to inhibit fine powder from penetrating the regulating threads of the pin which would otherwise cause jamming of pin 22.

It will be appreciated that the combination of elements shown for FIGS. 5 to 8 can also be used with the spray device construction shown in FIGS. 1 to 4.

Referring again to FIG. 5, the powder is fed by means of powder feed channel 17 which delivers the powder to powder inlet 20 and carrier gas duct 5, the valve pin 22 being longitudinally movable relative to the powder inlet, the powder suspended in the carrier gas being delivered by injector 6 into carrier gas-mixing duct 10. The flow of powder from container 8 is gravity assisted into injector area 24. Thus, as shown in FIG. 6, pin 22 is provided with a through-hole bore 27 and at least one cross channel orifice 28 so that the carrier gas can flow through the pin and emerge as a jet. As shown in FIG. 6, no powder can flow because the forward end 23 of the pin abuts directly against the inlet of the powder feed duct 10 and injector portion 37 is substantially completely closed.

Since flow of powder can be abrasive and cause wear, the flow should be as straight as possible through the ducts and, therefore, the use of abrasion-resistant materials and exchangeable wear parts are particularly preferred. Preferred materials of construction include hardened wear resistant steel, sintered hard metal carbides (e.g. sintered tungsten carbide) or the like which are desirable for assuring long life and operational safety of the torch. In feeding the powder and the gases as a mixture to the torch head, the injector principle should be used, the flow of the powder following a central straight-lined path through the injector and through the ducts.

It may be advantageous according to FIG. 4 to merge the fuel gas-oxygen mixing duct 9 with carrier gas-powder mixing duct 10 forward of the first (fuel gas-oxygen) injector and the second (carrier gas-powder) injector in the direction of the torch head, the area of introduction 21 providing an injector-type construction.

However, a straight-lined flow of the carrier gas-powder mix may limit the positions in which the torch can be oriented relative to a substrate or workpiece to be coated, especially where container 8 is fixed in only one position. Because the powder from the container is transported into the powder injector by the assistance of gravity, any marked variation from the horizontal in aiming the torch at a substrate may interfere with gravity flow of the powder.

Thus, it is advantageous to provide the powder container with a mounting coupling capable of allowing the container to be set or adjustable in many positions to compensate for change in position of the torch relative to the substrate being coated. One embodiment is shown by way of example in FIGS. 1, 5, 9 and 10 which aids in providing gravity feed of the powder.

In FIG. 1, a coupling 31 for connecting the powder container to the torch body of the spray device is shown axially offset with the vertical by means of mounting 54 which in turn is connected to a powder feed housing 55, the housing having a lever 56 for effecting or shutting off powder flow.

Referring to FIG. 10, powder feed channel 17A is shown in gravity-feeding relationship to powder container 8, depending on how the torch is tilted from the normal position relative to fixable channel connecting piece 38 (FIG. 1) attached in direct line to carrier gas duct 5 axially together with the powder feed. In another embodiment, the connecting piece or coupling 31A can be rotatably mounted on fixed stub shaft 45 through axial offset 31C such that, by rotating said offset coupling about stub shaft 45, container 8 can be adjusted to different positions.

The removable coupling 31A shown in FIG. 10 can be designed to provide a powder shut-off means or device. With such a device, different powders can be exchanged quickly and safely without considerable delay.

In FIG. 10, coupling 31A is turnably attached via screw 42 which enters offset 40 to which coupling 31A is connected, the coupling also being connected to container 8 as shown. Offset 40 has a cuplike cavity or a blind hole 41 which is a female counterpart of fixed stub shaft 45 shown in FIG. 5. The connection of coupling 31A to offset 40 is facilitated through gasket separator 44 as shown, the coupling having a partition 47 having at least one powder feed port or orifice 43 which is adjustably matable with powder feed channel 17A through a corresponding matable orifice 46 in gasket 44. In the position shown, the powder can flow from container 8 through holes 43, 46 into powder feed channel 17A or 17 (FIG. 5). By turning offset 40 about the axis of stub shaft 45 (FIG. 5), the position of the powder container relative to the torch head is changed as stated earlier. By merely turning coupling 31A (FIG. 10) with the container connected thereto relative to offset 40, the powder flow from the container is interrupted since the powder orifices or holes 43, 46 no longer align with each other.

In order to enable the simple handling of the torch, a main quick-acting gate valve 18 (FIGS. 5 and 8) is provided in back of control valves 15 and 16 (for the fuel gas and oxygen) for controlling flow in either the fuel gas duct or oxygen duct, or both, or even in the separate carrier gas line. Thus, with main valve 18, the torch can be shut off with one valve manipulation and then put back into operation without the necessity of resetting the various valves, such as 15 and 16.

In FIG. 5, the gas ducts in the spray gun are depicted phantomly by dotted lines above the handle. Fuel gas duct 3 passes through valve 16 as shown schematically and enters injector 1. Meanwhile, oxygen enters through oxygen duct 2, passes through valve 15 and from there centrally and axially through said schematically represented injector where the fuel gas and oxygen are mixed together in predetermined ratios. In the meantime, oxygen as carrier gas is conducted by branch line 4 through valve 11 for feeding to the powder feed section as shown.

Due to unavoidable heating of the torch head during operation because of heat generated at the torch head nozzle, the carrier gas-powder duct may heat up sufficiently as to cause the powder to adhere to the walls of the duct and cause clogging and thus interfere with obtaining a homogeneous coating on a metal substrate.

Figure 11:
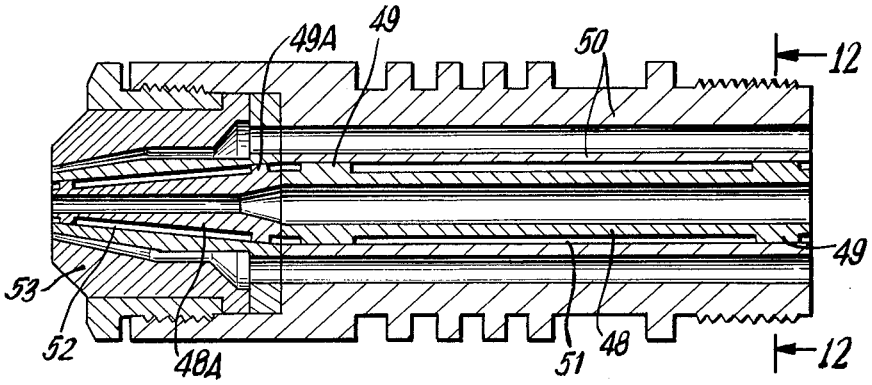
FIG. 11 is a cross section taken through the torch head in elevation along line 11—11 of FIG. 12.

To minimize the foregoing, the torch head is constructed to receive unmixed carrier gas as a cooling gas from a branch duct (not shown) coupled to the carrier gas line. Thus, a small portion of the carrier gas is conducted to the torch head shown in cross section in FIGS. 11 and 12, FIG. 12 being taken along line 12—12 of FIG. 11.

Figure 12:
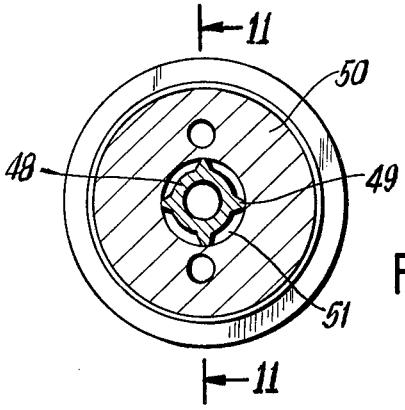
FIG. 12 is a cross section of the torch head taken along line 12—12 of FIG. 11.

As will be noted, a wear protective casing or duct 48 (sintered tungsten carbide or the like) is shown passing concentrically through the torch head, the casing 48 being provided with ribs or spacers 49 (note also FIG. 12). The casing 48 passes in self-locating relationship by means of said spacers through torch head casing 50 (FIG. 12) to provide a gas flow channel 51 of annular cross section which receives part of the carrier gas as a coolant and passes to corresponding ring-shaped channel 52 in nozzle head 53 which has tapered casing 48A (with spacer 49A) as an extension of casing 48. As stated above, the carrier gas is delivered to cooling channel 51 by a branch line not shown since such means are obvious to a person skilled in the art.

In operating the torch, the following gas pressures may be employed. The oxygen gas pressure may vary from about 3 to 6 atmospheres gage and the fuel gas pressure from about 0.2 to 1 atmosphere gage.

The ratio of the amount of oxygen fed to the fuel gas mixing injector and the amount of oxygen fed as carrier gas to the powder mixing injector may vary from 3:7 to 7:3. A ratio of 1:1 is particularly preferred. In the case where the carrier gas is fed separately to the powder mixing injector, the supply pressure of the carrier gas may be employed at the same range or higher as the pressure employed for oxygen set forth hereinabove.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A safety double injector spray device for applying a spray coating to a substrate comprising, a torch body having a torch head with a nozzle at the end thereof, an oxygen duct and a fuel gas duct associated with said spray device and coupled to a first injector means for mixing oxygen and fuel gas therein, a fuel gas-oxygen mixing duct located forward of and coupled to said first injector means, a carrier gas duct associated with said spray gun coupled to a second injector means for mixing spray powder with carrier gas fed to said duct, a carrier gas-powder mixing duct located forward of said second injector means, spray powder feeding means coupled to said torch body and communicating in powder-feeding relationship with said carrier gas duct and said second ejector means, and means forward of said first and second injector means for coupling said carrier gas-powder mixing duct and said fuel gas-oxygen mixing duct to said torch head.

2. The spray device of claim 1, wherein said carrier gas duct includes a branch duct line coupling said oxygen duct from before said first injector to said carrier gas duct, said oxygen duct providing carrier gas for said carrier gas duct.

3. The spray device of claim 2, wherein said branch line from said oxygen duct to said carrier gas duct has an adjustable valve therein.

4. The spray device of claim 3, wherein said branch line has a gas leak rate means associated therewith to provide an idle flow of oxygen at a predetermined leak rate through said carrier gas duct, even when the valve of said branch line is in the closed position.

5. The spray device of claim 4, wherein said valve in the branch line comprises a valve stem and a valve head and wherein said gas leak rate means comprises fine bores or grooves in the valve head of said branch line valve adapted to provide a predetermined leak rate with the valve head in the closed position.

6. The spray device of claim 4, wherein said gas leak rate means is a by-pass leak rate duct by-passing said branch line valve and coupled to said carrier gas duct to provide a continuous leak rate flow of oxygen to said carrier gas duct from said oxygen duct.

7. The spray device of claim 1, wherein said second injector means for mixing spray powder and carrier gas has a valve metering device cooperatively associated therewith for adjusting the amount of spray powder fed to said second injector means from said spray powder feed means for passage to said spray nozzle.

8. The spray device of claim 7, wherein said valve metering device is a pin coaxially and longitudinally movable into the opening of said powder injector means to vary the gap therebetween and hence the amount of powder fed to said powder injector means from said powder feeding means.

9. The spray device of claim 8, wherein said powder metering pin has a bore running coaxially therethrough with at least one cross channel orifice in the wall thereof near an end opposite said powder injector means, said at least one orifice communicating with said carrier gas duct.

10. The spray device of claim 9 wherein said pin passes through a gasket in sliding engagement therewith located at the forward end of said pin to inhibit powder from flowing rearward of said pin and cause clogging.

11. The spray device of claim 1, wherein the fuel gas-oxygen duct following the first injector means merges with the carrier gas-powder duct following the second injector means prior to entering the torch head, the region at which the ducts merge together defining a third injector for mixing said carrier gas-powder flow with said fuel gas-oxygen flow prior to injecting the total mixture into the torch head and the nozzle thereof.

12. The spray device of claim 1, wherein said carrier gas-powder duct and said fuel gas-oxygen mixing duct are each coupled via means to said torch head, whereby the mixing of the carrier gas-powder flow and the fuel gas-oxygen flow is effected at the nozzle of said torch head.

13. The spray device of claim 1, wherein the spray powder feeding means includes a powder container coupled to the torch body via a mounting on said torch body, said mounting having a powder feed channel passing therethrough.

14. The spray device of claim 13, wherein the mounting for said powder container means is a stub shaft projecting upwardly from said torch body with said powder container rotatably mounted via coupling means to said stub shaft, said stub having a feed channel passing therethrough in gravity-assisted communication with said powder container, said feed channel entering the torch body and communicating with the carrier gas duct in back of said second injector.

15. The spray device of claim 14, wherein said powder container is mounted via said coupling means axially offset at an angle relative to said stub shaft, whereby said container can be rotated in various axially offset positions depending upon the working positions of said spray device relative to a substrate being sprayed, said axially offset position of said powder container providing gravity assisted feed of powder from the container to said feed channel.

16. The spray device of claim 15, wherein the powder container coupling is provided with means for closing off the powder feed from said powder container to said feed channel.

17. The spray device of claim 1, wherein the carrier gas-powder mixture duct is disposed in a straight line from said second injector to said nozzle.

18. The spray device of claim 17, wherein the carrier gas-powder mixture duct is characterized by a replaceable liner of a wear resistant material.

19. The spray device of claim 1, characterized by valve means for cutting off all gas feeds.

20. The spray device of claim 1, wherein the torch head of said torch body has an annular cooling chamber for receiving gas from the carrier gas duct for effectively cooling said torch head during use.

21. The spray device of claim 20, wherein said annular cooling chamber is formed of a wear-protective casing supported by radial spacers in said torch head.

* * * * *